US005338368A

United States Patent [19]

Fletcher et al.

[11] Patent Number: 5,338,368

[45] Date of Patent: Aug. 16, 1994

[54] METHOD FOR REMOVING OIL OR ASPHALT FROM INORGANIC PARTICLES HAVING PIGMENT IN AN OUTER LAYER THEREOF

[75] Inventors: Robert B. Fletcher, Peterborough, Canada; Wilson S. Bigham, Woodbury, Minn.; Phyllis F. Albert, River Falls, Wis.

[73] Assignee: Minnesota Mining and Manufacturing Company, St. Paul, Minn.

[21] Appl. No.: 125,333

[22] Filed: Sep. 22, 1993

[51] Int. Cl.[5] ..... C23G 5/02; B08B 7/00; B08B 3/04

[52] U.S. Cl. ..... 134/40; 134/38; 134/34; 134/25.1

[58] Field of Search ..... 134/40, 38, 34, 25.1

[56] References Cited

U.S. PATENT DOCUMENTS

| | | | |
|---|---|---|---|
| Re. 29,649 | 5/1978 | Farnsworth | 134/40 |
| 2,164,329 | 7/1939 | Jewett | 91/70 |
| 2,362,489 | 11/1944 | Jewett | 117/100 |
| 2,595,465 | 5/1952 | Keene et al. | 117/27 |
| 2,614,051 | 10/1952 | Buzzell et al. | 117/27 |
| 3,013,893 | 12/1961 | Olson et al. | 117/27 |
| 3,255,031 | 6/1966 | Lodge et al. | 117/27 |
| 3,528,842 | 9/1970 | Skadulis | 117/27 |
| 4,511,488 | 4/1985 | Matta | 252/162 |
| 4,582,425 | 4/1986 | Rabine et al. | 356/36 |

FOREIGN PATENT DOCUMENTS

| | | | |
|---|---|---|---|
| 9210314 | 6/1992 | PCT Int'l Appl. | 134/40 |

OTHER PUBLICATIONS

Industrial Solvent Catalog published by PT Technologies, Inc., Safety Harbor, Fla., "PF TM A Safe 100% Volatile Industrial Degreaser Solvent", 1991. No Month Available.

Trade Brochure published by AMAC Equip. Ltd., Richmond Hill, Ontario, Canada, on PF TM Degreaser, 1992. No Month Available.

Product/Material Safety Data on BBA Solvent K102, published by Bush Boake Allen, Jacksonville, Fla., 1992.

Material Safety Data sheet on BBA Solvent K411, published by Bush Boake Allen, Jacksonville, Fla., 1992.

Product Data on BBA Solvent 401, published by Buch Boake Allen, Jacksonville, Fla., undated.

Product data on Zep Big Orange TM citrus industrial strength cleaner, degreaser and deodorizer, published by Zep Manuf. Co., Atlanta, Ga.

Product/Material Safety Data on Zep C-SOLV non--emulsifying industrial greaser, published by Zep Manuf. Co., Atlanta, Ga.

Product/Material Safety Data on Zep Formula 50 TM Heavy-duty all purpose cleaner and degreaser, published by Zep Manuf. Co., Atlanta, Ga.

*Primary Examiner*—Paul Lieberman

*Assistant Examiner*—Lorna M. Douyon

*Attorney, Agent, or Firm*—Gary L. Griswold; Walter N. Kirn; Ramon R. Hoch

[57] ABSTRACT

A method for deoiling oil residues from surfaces of inorganic particles each having pigment in an outer layer thereon, comprising contacting the surfaces with a deoiling solution comprising a mixture of monocyclic terpene and aliphatic petroleum distillates in an amount and manner effective to wet substantially all the surfaces of the inorganic particles, whereby the deoiling solution removes substantially all the oil residues from the surfaces of the inorganic particles. In a preferred embodiment, there is a method for deoiling oil residues from surfaces of inorganic particles each having pigment in an outer layer thereon including introducing the inorganic particles into a structure having a wall portion which defines a receptacle having upper and lower openings, the structure including a porous support member having a pore size which permits the passage of liquid but not the inorganic particles located in the receptacle between the first opening and the second opening to define a particle holding chamber, and, then, deoiling the inorganic particles by introducing into the upper opening a deoiling solution comprising a mixture of monocyclic terpene and aliphatic petroleum distillates, and, then, rinsing the deoiled inorganic particles with water and drying the rinsed inorganic particles, in that order.

13 Claims, 3 Drawing Sheets

METHOD FOR REMOVING OIL OR ASPHALT FROM INORGANIC PARTICLES HAVING PIGMENT IN AN OUTER LAYER THEREOF

BACKGROUND OF THE INVENTION

1. Field of the Invention

This invention relates to a novel method for removal of oil or asphalt from surfaces of inorganic particles having pigment in an outer layer thereof with a non-chlorocarbon solvent comprising a mixture of monocyclic terpene and aliphatic petroleum distillates. The method is especially applicable to the deoiling of roofing granules having pigment in an outer ceramic coating thereon.

2. Description of the Related Art

Inorganic particles having pigments present in an outer layer thereof, such as naturally and artificially color-coated granules, are ubiquitous in the roofing and siding industry. Exemplary applications thereof are in granular surfaced bituminous roll roofing and asphalt shingles. The granules, as partially embedded in one surface of asphalt-impregnated and asphalt-coated fiber sheet material, form a coating to provide an inherently weather-resistant and decorative exterior surface.

Typically, and as explained, e.g. in U.S. Pat. No. 3,528,842, colored inorganic particles used as roofing and siding granules are manufactured by coating a crushed mineral or rock granule substrate with a suitable pigment to form a ceramic bond. The coating is formed from a solublized silicate solution which is insolublized either by heat treatment or a combination of heat treatment and chemical action to a substantially water-insoluble state and is strongly adherent to the base granule. In carrying out these methods the pigment is typically uniformly applied to the granular surface with the soluble silicate solution, and the silicate is insolubilized as noted above in the presence of an acidic material or clay. Other patents which are representative of the state of the art in making pigmented granules include U.S. Pat. Nos. 2,111,131; 3,255,031 and 3,507,676.

In any event, oil, such as naphthenic slate oil, is typically used during the production of such roofing granules as a carrier for treatments, e.g. as an adhesion medium, and for dust-suppression. This oil temporarily remains on the surface portions of the finished roofing granules after processing is completed. This residual surface oil often can effectively change the color or chroma of the granules. However, the oil is eventually removed from the granules as a result of natural weathering once the granules are put into service and exposed to the elements. This loss of oil effects an apparent color change in the granules, which is instrumentally and visually discernible. This color change can occur in a relatively short period of time once the granules are put into service, e.g. after only two weeks to three months.

As can be understood, the deoiled color of the granules is of greater interest and relevance to all concerned in selecting a color of granule to be put into service than the temporary oiled color as it represents the ultimate permanent color of the shingled roof, and the like.

Therefore, for quality control in the roofing industry, manufacturing specifications for granule color are determined industry-wide on a "deoiled" basis of the production samples of colored granules. Techniques for removing oil from the granules have been proposed and used in the field. Since it is inefficient for a roofing granule manufacturer to use natural weathering to ascertain the deoiled color of a particular produced batch of granules, organic solvents typically have been used to readily remove oil from production samples of granules to determine their deoiled color and ascertain whether such conforms to industrial standards on color grades before the product is released into the market.

For instance, one widely-accepted procedure for determining the true color or deoiled color of produced granules involved the use of a chlorocarbon solvent, namely 1,1,1-trichloroethane. For example, in one standard procedure using 1,1,1-trichloroethane as a deoiler for pigmented roofing granules, a sample of oiled granules was first screened to Tyler mesh size −14/+20 (US Standard −16/+20). The screened sample was then placed in a 100 milliliter beaker, the granules filling up to 50 milliters of a beaker. The beaker was then filled to the rim with 1,1,1-trichloroethane. The granules and 1,1,1-trichloroethane were then allowed to sit undisturbed for about five minutes. The granules and trichloroethane were then poured into a deoiling funnel and the solvent drained without stirring into a one gallon can. Next, the funnel was filled with distilled water to the rim and stirred while draining, being sure to collect all solvent and water for proper disposal. The remaining granule samples in the funnel were placed on a white paper towel and dried in a vented oven. As to the temperature of the drying oven, temperatures ranging from about 80° C. to about 110° C. are suitable, and the samples merely needed to be taken out when dry. However, the temperature of the drying oven also could be set at 150° C. Finally, the dried granules were cooled on paper towels to room temperature on a table top prior to making any color determinations. Then, to analytically determine the color of the deoiled granules, the granules preferably have a L*a*b* delta compared with a standard granule of +/−1.0.

The L*a*b* color space test is discussed in greater detail herein. Briefly, a sample of deoiled granules is placed in a machine fitted with a defined light source and the reflectance from the sample recorded on three different color scales according to the "opponent-colors" scales. The opponent color scales give measurements of color in units of approximate visual uniformity throughout the color solid. In general, "L*" measures lightness and varies from 100 for perfect white to zero for black, approximately as the eye would evaluate it. The parameters "a*" and "b*", the chromatacity dimensions, give understandable designations of color as follows: a* measures redness when plus, gray when zero and greenness when minus; b* measures yellowness when plus, gray when zero and blueness when minus.

However, the past use of chlorocarbons solvents, and especially 1,1,1-trichloroethane, for deoiling granules, although satisfactory and widely used for deoiling per se, now has serious drawbacks. As now widely acknowledged, chlorocarbons contribute to the depletion of the earth's ozone layer. In fact, international committments have been made under the Montreal Protocol to phase out the production and use of chlorocarbons. Therefore, industries have been urgently seeking effective alternatives to the obsolescent chlorocarbons, including chlorocarbon solvents such as 1,1,1-trichloroethane.

However, the roofing granule industry has acquired a substantial body of knowledge and experience on the deoiling action and color space test attributes of pigmented inorganic particles deoiled by 1,1,1-trichloroethane. Therefore, it would be highly desired and less traumatic for the roofing and siding particle industry if a replacement could be identified for 1,1,1-trichloroethane which not only correlates well with natural weathering but which also has deoiling performance akin to its predecessor 1,1,1-trichloroethane.

In general, a large number of substitutes for chlorocarbon liquid solvents have been proposed in recent times. For instance, T&R Chemicals Inc. proposes certain para-menthadienes formed in a process from pine tree turpentine as a solvent material, designated MSOL, as general substitute for chlorocarbon solvents. This MSOL solvent, in turn, is said to be an effective alternative to a competing non-chlorocarbon solvent of citrus limonene (d-limonene) produced in the orange juice processing industry, which, in some cases, depending on the predilections and olfactory sensitivity of the user, is characterized as having a strong overpowering odor.

Also, Bush Boake and Allen, a Union Camp Corporation, has advertised a solvent designated BBA Solvent 401 (or 411) as a terpene-derived solvent specifically designed for use in a newly-developed cleaning process for electronic and precision engineering components, which is said to be an environmentally responsible alternative to the use of CFC's and chlorinated hydrocarbons. This company also advertises a solvent designated BBA Solvent K102, which is said to be a proprietary degreasing mixture of terpene hydrocarbons (p-menthadienes) and terpene alcohols useful for a wide range of industrial cleaning processes with low environmental impact.

Another solvent that is touted as containing no chlorinated hydrocarbons or petroleum distillates is designated ZEP BIG ORANGE TM, a naturally occurring citrus solvent made by Zep Manufacturing Company. ZEP BIG ORANGE TM solvent is said to be an industrial degreaser for motors, engine parts, etc. and industrial parts, a tar and asphalt emulsifier, a good cleaner for unpainted concrete which may damage painted surface and an excellent grafitti remover. Another solvent advertised by Zep Manufacturing Company as having no chlorinated solvents such as 1,1,1-trichloroethane is ZEP C-SOLV TM, which is said to be useful for degreasing operations such as tank cleaning and electric motors.

Also, West Penetone advertises a safer degreaser than 1,1,1-trichloroethane designated CITRIKLEEN® XPC, which is non-chlorinated and nonpetroleum based, and said to be used for removal of carbon black, graphite, liquified polymers, tar, asphalt, greases and oils from hard metal and non-metal surfaces.

PT Technologies, Inc. advertises a solvent designated PF TM Degreaser as a replacement for harmful solvents such as 1,1,1-trichloroethane, freon, methyl ethyl ketone, acetone, mineral spirits. PF TM Degreaser is said to be useful for industrial applications where a 100% volatile solvent is preferred and can be used to remove hydrocarbon, silicone, or polyethylene based greases, oils, tars and gels. The PF TM Degreaser solvent is said to have passed common carrier aircraft metals compatibility testing, and is said to be safe to use prior to painting, and on painted surfaces.

However, the deoiling action that any given solvent may have on a pigmented ceramic-coated granule is highly unpredictable. That is, the solvent used must deoil the surface regions of granules in a relatively consistent repeatable manner, e.g., in terms of the color space test readings taken on the deoiled granules, and without freeing or leaching pigments from the granules or otherwise permanently disturbing the unique and specific morphology and composition of the granules and their surface coating(s). Importantly, the deoiling effected by the solvent used to deoil the granules must correlate well with deoiling caused by natural weathering in order to provide an accurate and reliable predetermination of whether the pigmented granules are either inside or outside industry specifications. Also, the solvent must be relatively safe to handle such as in terms of its flammability, noxiousness and pungency.

None of the above literatures specifically describe an application of a nonchlorocarbon solvent towards meeting the peculiar requirements arising in and associated with deoiling pigmented inorganic particles, and especially pigmented ceramic-coated inorganic particles for grading purposes, and the industry has urgently awaited for and would place value on such a discovery.

SUMMARY OF THE INVENTION

An object of the present invention is to provide a method to deoil inorganic particles having pigments in at least the outer surfaces thereof with a solvent which does not disturb the surface morphology, pigments therein or composition of the particles, has acceptable pungency from health and safety standpoints, and which deoils the particles in a consistent manner which correlates well with natural weathering and the action of obsolescent chlorocarbon solvents such as 1,1,1-trichloroethane. Among other things, a deoiling action is desired which correlates well with natural weathering and 1,1,1-trichloroethane in the sense of oil removal and color space test values, such as described herein, as taken on the deoiled particulate.

It is another object of the present invention to provide a method to deoil pigmented inorganic particles having oily residues on surfaces thereof to determine whether the pigmented inorganic particles, especially roofing granules and the like, meet industry color specifications. It is yet another object to provide a method to provide ready-to-use deoiled pigmented inorganic particles.

These and other objects of the present invention have been attained by the present inventors' discovery of a method for removing oil residues from surfaces of inorganic particles each having pigment in an outer layer thereon, comprising contacting the surfaces with a deoiling solution comprising a mixture of monocyclic terpene and aliphatic petroleum distillates in an amount and manner effective to wet substantially all the surfaces of the inorganic particles, whereby the deoiling solution removes substantially all the oil residues from the surfaces of the inorganic particles.

In a preferred embodiment, this invention relates to a method for removing oil residues from surfaces of inorganic particles each having pigment in an outer layer thereon, comprising the steps of:

(a) providing a structure having a wall portion which defines a receptacle, the wall portion including an upper wall portion which includes a first opening for introducing inorganic particles into the receptacle, a lower wall portion having a second opening therethrough for discharging liquids from the receptacle, the structure including a porous support member having a pore size which permits the passage of liquid but not the inorganic particles located in the receptacle between the first opening and the second opening to define a particle holding chamber;

(b) introducing an amount of the inorganic particles, without compacting, into the particle holding chamber of the receptacle at the first opening, whereby the inorganic particles are supported on the porous support member;

(c) introducing a deoiling solution comprising a mixture of monocyclic terpene and aliphatic petroleum distillates into the first opening in an amount and manner effective to flow downward through interstices between the inorganic particles to contact and wet substantially all the surfaces of the inorganic particles, whereby the deoiling solution removes the oil residues from the surfaces of the inorganic particles and flows out of the second opening;

(d) then, introducing water into the first opening to rinse the deoiled inorganic particles; and (e) drying the rinsed inorganic particles at a temperature and for a duration effective to volatize substantially all residual deoiling solution and water from the surfaces of the inorganic particles.

In a preferred embodiment, the above-mentioned method uses a deoiling solution comprising d,l-limonene as monocyclic terpene in an amount of from about 10% to 30%, by weight, and 100% aliphatic petroleum distillates in an amount of from about 90% to 70% by weight, based on total weight deoiling solution.

For purposes of the present invention, a "monocyclic terpene" means a one-ring terpene structure, and its saturated or partially saturated isomers, as well as its derivatives, e.g., alcohols, aldehydes, and esters. In a more preferred embodiment, the monocyclic terpene usable in the present invention is that as defined in CAS# (Chemical Abstracts Service No.) 5989-27-5, which indicates d,l-limonene.

For purposes of the present invention, "aliphatic petroleum distillates" are generally defined as a highly complex mixture of aliphatic paraffinic and cycoparaffinic (naphthenic) hydrocarbons derived from cracked or distilled petroleum, such as a mixture of any of naptha of several grades, gasoline, kerosene, fuel oils, gas oil, lubricating oils, paraffin wax and asphalt. More specifically, the "aliphatic petroleum distillates" preferred in the present invention are those as defined in CAS# (Chemical Abstracts Service No.) 64771-28-8.

In another preferred embodiment of the invention, the receptacle which supports the grains during the deoiling processs is selected to be a conical funnel structure.

In yet another embodiment, the invention relates to a method for deoiling oil residues from surfaces of inorganic particles each having pigment in an outer layer thereon and determining the color grade thereof, comprising:

(a) providing a structure having a wall portion which defines a receptacle, the wall portion including an upper wall portion which includes a first opening for introducing inorganic particles into the receptacle, a lower wall portion having a second opening therethrough for discharging liquids from the receptacle, the structure including a porous support member having a pore size which permits the passage of liquid but not the inorganic particles located in the receptacle between the first opening and the second opening to define a particle holding chamber;

(b) introducing an amount of the inorganic particles, without compacting, into the particle holding chamber of the receptacle at the first opening, whereby the inorganic particles are supported on the porous support member;

(c) introducing a deoiling solution comprising a mixture of monocyclic terpene and aliphatic petroleum distillates into the first opening in an amount and manner effective to flow downward through interstices between the inorganic particles to contact and wet substantially all the surfaces of the inorganic particles, whereby the deoiling solution removes the oil residues from the outer surfaces of the inorganic particles and flows out of the second opening;

(d) then, introducing water into the first opening to rinse the deoiled inorganic particles;

(e) drying the rinsed inorganic particles at a temperature and for a duration effective to volatize substantially all residual deoiling solution and water from the outer surfaces of the inorganic particles;

(f) performing a L*a*b* color analysis on the deoiled particles; and (g) comparing results of the L*a*b* color analysis against the industry specification applicable to the pigmented inorganic particles.

The invention itself, both as to its method of application and its support technology, together with additional objects and advantages thereof, will be better understood from the following description of the preferred embodiments of the present invention.

DESCRIPTION OF THE PREFERRED EMBODIMENTS

Deoiling Solvent

Figure 1:
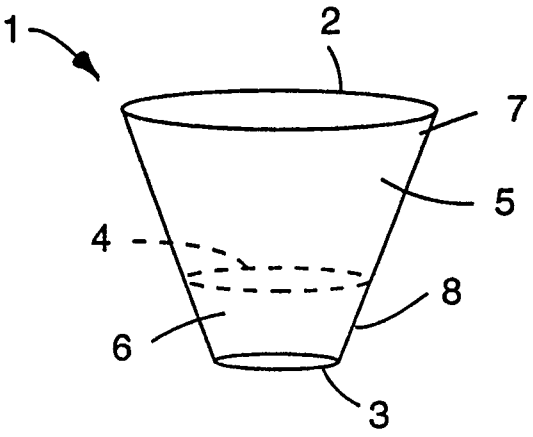
FIG. 1 is a side perspective view of a deoiling receptacle of the present invention having a funnel structure, where the hatched lines indicate hidden features.

In a preferred embodiment, the deoiling solvent comprises a blend of monocyclic terpene in an amount of from about 10% to 30%, by weight, and aliphatic petroleum distillates (100% aliphatic) in an amount of from about 90% to 70% by weight, based on total weight deoiling solution.

A suitable source of the above deoiling solvent blend material is available from PT Technologies, Inc., Safety Harbor, Fla., and is designated as PF TM Degreaser (Category A: 100% volatile solvent ingredients). The Canadian distributor of PF TM Degreaser, AMAC Equipment, Ltd., describes the PF TM Degreaser, in Material Safety literature, as comprising up to 90% by weight 100% aliphatic petroleum distillates (100% aliphatic) {CAS# 64771-28-8} and up to 30% by weight monocyclic terpene hydrocarbon {CAS#5989-27-5}. Preferably, the amount of monocyclic terpene constitutes from about 10% to 30% by weight of the total deoiling solvent blend used in the present invention.

The use of higher amounts of the monocyclic terpene, e.g. d,l-limonene, such as greater than 30% by weight of the total solvent blend, may be unacceptable from a health and safety standpoint as the compound is classified as combustible. Care should be taken to perform the deoiling method of the present invention in a ventilation hood as a precaution. On the other hand, if the amount of monocyclic terpene is below 10% by weight, insufficient deoiling action might occur, depending, in part, on the particular type of slate oil being removed. In any event, a satisfactory blending ratio of d,l-limonene and aliphatic petroleum distillates can be determined empirically by the skilled technician to suit the materials at hand.

As to physical properties, the PF Degreaser has a vapor pressure less than 1 mm Hg at 25° C.; a vapor density greater than 1 (wt/vol where air=1); a specific gravity of 0.75; a flashpoint of 62° C.; a boiling point of 193°-221° C. and upper and lower flammability limits of 7% and 0.6% by volume, respectively; and is a clear liquid described as having a faint citrus odor.

The deoiling solvent, as described herein, used in the present invention is effective, in general, to remove naphthenic slate oils, silicone oils, paraffinic oils, phenolic oils and asphalt from the surfaces of the inorganic particles. The amount of solvent used in the deoiling procedure is not particularly limited. In general, the amount of solvent can be that which is sufficient to deoil the granules treated with an effective or reasonable amount of slate oil for conventional purposes such as dust suppression; that amount being known by those skilled in the art. In general, amounts of slate oil for roofing granules, and the like, of up to about 20 lbs oil/ton inorganic particles (up to about 0.1 and 10 kg/metric ton) are satisfactorily removable by the deoiling method of the present invention. Freshly manufactured roofing granules, for example, typically will have about 1 to 20 lbs. oil surface residue/ton of granules (about 0.5 to 10 kg oil surface residue/metric ton of granules).

Inorganic Particles

The pigmented inorganic particles or granules applicable to this invention generally comprise a substrate of porous mineral or rock having at least one outer layer containing a pigment. For example, the outer layer can comprise a ceramic coating containing at least an insolubilized silicate and the pigments. The inorganic substrate granules of the inorganic particles applicable to the invention are conventional and can be from any one of a rather wide class of relativley porous and weather resistant rock and minerals. Examples of relatively porous materials are trap rocks and slates. Examples of relatively porous and non-porous rocks and minerals are argillite or greystone (such as the large greystone deposits locayed north of Wausau, Wisconsin), greenstone, certain granites and the like. These substrates have substantial porosity as compared to a typical ceramic coating provided on the inorganic substrate.

Representative inorganic particles applicable to the invention, include ceramic-coated granules which are coated with a suitable pigment in an inorganic bond, such as described in U.S. Pat. Nos. 3,528,842 to Skadulis; 3,507,676 to McMahon and 3,255,031 to Lodge et al. These references encompass clay-silicate coated pigmented particles and borate-clay-silicate coated pigmented particles. These types of ceramic coated particles can have multiple ceramic coatings formed on the substrate granule, e.g. 1-3 layers, with a pigment selected to render the desired color as added to any of the ceramic coating layers.

Known pigments for these inorganic particles include carbon black, titanium dioxide, chromium oxide, yellow iron oxide, phthalocyanine green and blue, ultramarine blue, red iron oxide, metal ferrites, and mixtures thereof. In general, the amount of pigment added is that sufficient to coat and color the particle surface. However, the exact amount of pigment will depend on many variables including the color desired and the presence of heavy additives such as cuprous oxide; although, e.g., 20 to 140 lb pigment/ton of inorganic particles (10 to 70 kg/metric ton) may be a generally representative range amount. The ceramic coatings also may contain an algicidal copper compound, such as cuprous oxide, such as described In U.S. Pat. No. 3,528,842. Though not the particular subject of the present invention, suitable techniques for forming such pigmented ceramic coatings on inorganic particles are widely known and practiced in the field.

More relevant to the present invention, prior to the use of the above-described ceramic coated inorganic particles, the pigmented particles usually are treated to reduce dust generation during processing and to improve adhesion to the materials used in a backing support sheet, e.g. a bituminous asphalt sheet material in the case of roofing granules. Typical treatments, include oil treatments, such as silicone oils which help in wicking of pigment into the granule, and, traditionally, naphthenic slate oil has been utilized for dust control and as an adhesion medium between the granule and asphalt.

As explained previously, for quality control, ultimate exposed color of the pigmented inorganic particle is the most critical feature; therefore, the exposed color must be assimilated through a deoiling process. The deoiling procedure of the present invention can use the following equipment and method of operation.

Deoiling Receptacle

Preferably, the receptacle used in the present invention has a configuration which tapers inward from an upper opening at the top of a walled structure towards a lower opening at the bottom thereof, wherein a screen member is located inside the funnel between the two openings. More preferably, the receptacle has a conical funnel structure to provide an optimal flow profile for the solvent through the inorganic particles. More specifically, the conical funnel structures of this invention can be characterized as having a frustum shape, wherein the upper opening is circular and can be considered as the cone base while the lower opening can be considered as within an imaginary plane which cuts the side edges of a cone below the apex thereof. Therefore, a conical structure of the receptacle of the invention has a circular upper opening having a larger diameter than the circular lower opening whereby the side edges of the structure smoothly taper inward from the upper opening to the lower opening through a series of successively smaller circular cross-sections.

For example, the receptacle can comprise a regular conical funnel structure 1, as depicted in FIG. 1, having the first opening 2 at the upper wall portion 7 thereof for introducing the inorganic particles (not shown) having a diameter of about 7 cm, and a second opening 3 at the lower wall portion 8 thereof for draining the solvent (not shown) having a diameter of about 0.4 cm, and a support member 4, such as a screen support, located inside the funnel in-between the two openings at about 3.2 cm above the second opening and about 5.8 cm below the first opening, and the diameter of the funnel at the location of the screen support is about 3.2 cm. The apertures (not shown) in the support support member have a size that is greater than 425 μm but less than 710 μm (−24/+40 U.S. standard sieve mesh size) with the proviso that they are smaller in size than the inorganic particles to permit passage of liquid but not the inorganic particles.

In one embodiment, the support member can be arranged as extending horizontally across the interior of the receptacle, and preferably entends across an entire cross-sectional are of the receptacle to further ensure that no oily particles inadvertently fall out of the receptacle through the lower opening during the introduction of the inorganic particles into the receptacle, or during deoiling or rinsing. As to the geommetry of the apertures, square openings in a mesh-like screen structure are conveniently used. However, the geommetry of the aperture is not necessarily limited thereto. For instance, circular openings also can be used. The aperture size can range from greater than 425 μm to less than 710 μm.

By way of example, and also by reference to FIG. 1, the total volume of a conical shaped receptacle of the invention, such as described herein above, can be about 130 $cm^3$, and the volume of holding chamber compartment 5 for the inorganic particles, as measured as the volume space delimited by the upper surface of the support member, interior side walls of the funnel and upper opening of the receptacle, can be about 120 $cm^3$, and the volume of the drainage compartment 6 below the support member, as measured as the volume space delimited by the lower surface of the support member, interior side walls of the funnel and lower opening of the receptacle can be about 10 $cm^3$.

Other funnel geommetries, such as rectangular funnel or spheric, also are within the scope of the invention.

Deoiling Protocol

The inorganic particles to be deoiled usually are first mesh-screened to a size of at least greater than the aperture sizing in the screen member housed in a funnel-configured receptacle, such as described herein. Although screening of the oily particles before deoiling is not essential to the successful exercise of the invention, if a spectrocolorimeter analysis, as described herein, is contemplated for the particles after deoiling, then the particles are first screened to a size of greater than 850 μm to less than 1.18 mm (−16/+20 U.S. standard sieve mesh) before deoiling and only that fraction is deoiled in order to reduce variability in the results of the later spectrocolorimeter analysis.

In a preferred mode of the invention, the screened inorganic particles are then introduced into the funnel receptacle described herein as loosely supported by the support screen without compacting. That is, in the preferred mode of the invention, the particles are not presoaked with the solvent in a separate container or beaker before introduction into the funnel. Therefore, this embodiment of the invention omits a presoak step usually thought to be required and practiced in conventional deoiling procedures that use 1,1,1-trichloroethane.

That is, the nonchlorocarbon solvent used in the practice of the method of this invention, as described herein, is introduced into the upper opening of the funnel in an amount sufficient to wet substantially all the surfaces of the oiled inorganic particles previously introduced in a dry state and supported therein. Care should be taken to spread the deoiling solvent uniformly over the oily inorganic particles by hand pouring in a gentle swirling motion or dispensing by any other convenient means or manner such that the deoiling solvent wets all or substantially all the outer surfaces of the oily inorganic particles. The application of the solvent to the particles can be conveniently performed at room temperature (about 25° C.). During this application of the solvent to the inorganic particles, the receptacle preferably should be located inside an air hood or the like during the deoiling procedure since the solvent is volatile and combustible.

As to the amount of solvent utilized, the deoiling solution generally is contacted to the outer surfaces of said inorganic particles supported in the funnel without stirring in an amount and manner effective to wet substantially all the surfaces of the inorganic particles, i.e., at least about 95% of the total surface area of the particles, and preferably all the surface areas of the particles are wetted. In this regard, a suitable amount of solvent is from about 45 to 85 ml deoiling solution/50 g inorganic particles, and even more preferably, from 50 to 60 ml deoiling solution/50 g inorganic particles. The solvent preferably is poured into the funnel and over the entire upper surface of the stacked particles in a relatively short and continuous manner so that all the particles are wetted at substantially the same time. Solvent amounts less than 45 ml solvent/50 g particles may not be sufficient to sufficiently wet the surfaces of particles, and amounts greater than 85 ml solvent/50 g particles may not show any further increase in deoiling action provided. The solvent described herein for use in this invention vigorously liberates the oil residues from the surfaces of the inorganic particles. Most of the liberated oil drains away with the bulk portion of the solvent which immediately flows out of the receptacle after migrating through the particles and support member. Any remainder of liberated oil which is dissolved in the small residual portion of the solvent which continues to wet the particle surfaces after drainage of the bulk, is eliminated by the water rinse step, described hereinafter.

After the deoiling, the deoiled particles are rinsed by filling the funnel to the rim with distilled water. Stirring is not required during the rinse step; although gentle stirring with a stir rod can be used to assist the wetting of the surfaces of the particles with the water if care is taken not to cause attrition of the pigmented surface portions of the particles. All solvent and water should be captured for appropriate disposal or recycle.

After the water rinse, the particles are placed on a paper towel and dried in an oven. The removal of water residue from the particle surfaces is the rate determining step as water has a higher boiling point than the residual solvent. Drying can effected at about 80° C. to 115° C. and for a duration of about 6 to 13 minutes, more preferably at 115° C. and for a duration of 10 minutes. At temperatures above 115° C., the samples must be closely watched and removed as soon as possible when dry or the color may be affected. In any event, the dried particles can then be cooled on paper towels to room temperature on a table top prior to making color determinations.

In an alternate mode of the invention, the oiled inorganic particles are presoaked with the deoiling solution before introduction into the screening receptacle. In this embodiment with presoak, the oiled particles are soaked for at least 5 minutes, preferably about 10 to 15 minutes, in a container or beaker at room temperature with the amount of the solvent, also of the type described herein, provided to be sufficient to wet all the surfaces of the particles, e.g., 45 to 85 ml solvent per 50 g of particles. Gentle swirling of the contents of the beaker can be used to facilitate wetting of the solvent onto the surfaces of the particles. However, once so wetted, the contents of the beaker can be permitted to rest for the balance of the soaking period. After soaking, the contents of the beaker, including the solvent, free oil, and particles are poured into the receptacle, such as described hereinabove, to separate the deoiled particles from the solvent. The deoiled particles are dried in the same manner described hereinabove.

After deoiling the inorganic particles, the spectrocolorimeter analysis can then be performed on the deoiled dried inorganic particles as follows.

TEST METHODS

Color Analysis Method: L*a*b* Scan Color Matching Test

Since color is the first stimulus that the consumer perceives, resulting in an immediate evaluation of roofing granule quality, color consistency is one of the principal quality attributes of roofing granules. To determine the color of pigmented inorganic particles or roofing granules after deoiling, a machine known under the trade designation "HunterLab LabScan Spectrocolorimeter" model 6000, available from HunterLabs, Reston, Va., was used. A sample preparation device, which is described in U.S. Pat. No. 4,582,425, was used to prepare the samples.

The spectrocolorimeter is designed to measure the reflectance color of objects. The spectrocolorimeter measuring geometry used was 0°/45°. This geometry provided for viewing the samples similar to normal visual evaluation, with 0° illumination, or perpendicular illumination of the sample, in 45° viewing of the sample. 45° circumferential viewing effectively excludes the specular (glossy) reflectance. This geometry essentially eliminated the effect of the sample directionality or granule texture.

As explained in the HunterLab LabScan Spectrocolorimeter operation brochure, light from a halogen lamp passes through a series of filters and lenses to simulate D65 daylight and eliminate heat, and is focused on the sample in a circular pattern. Granular color was read in "Illuminant D65", which represents daylight with a correlated color temperature of approximately 6500° Kelvin. Light diffusely reflected from the sample is collected by sixteen fiber optic bundles staged circumferentially at 45° to the sample. The light input from all stations was averaged to eliminate errors caused by sample texture and directionality, and was then directed onto the circular variable filter which was spun continuously, separating the light into its component wavelengths. The separated light was picked up by a single photo detector, and then fed to a personal computer via an analog-to-digital converter. The computer processes measurement data at 10 nanometer intervals across the visual spectrum, from 400 to 700 nanometers.

For the color determination tests, a 10° CIE Standard Observer (CIE stands for the Commission International de l'Eclairage, an international commission on illumination) was used. The "Standard Observer" is the spectral response characteristic of the average observer defined by the CIE. Two such sets of data are defined, the 1931 data for the 2° visual field (distance viewing) and the 1964 data for the annular 10° visual field (approximately arms length viewing). A much better agreement with the average visual assessment can be obtained by making use of the 10° standard observer, and thus this was the observer used in these tests.

For each color granule tested, a sample was scanned by the spectrocolorimeter. This scan produced a numerical description of the colored sample, a fingerprint, which never changes. However, since it does not consider the lighting condition and the observer, the XYZ values do not completely describe the visual appearance of the color. That is, a mathematical means of translating fingerprints into a set of three numbers (XYZ), tristimulus values, was developed. The tristimulus values describe color as a normal observer sees it under a specific lighting condition.

Because the tristimulus values (XYZ) do not provide either uniform or logical estimates of perceived color intervals or color relationships, scales based on the CIE standard observer were transformed into an "opponent-colors" theory of color vision. The 1976 CIE L*a*b* is one such transformation. The opponent-colors theory maintains that the interaction between the eye and the brain decodes the experience of a color into three specific signals. One of these signals is lightness-darkness (L*), one is red-green (a*) and one is yellow-blue (b*). This color system was chosen for use in these tests because it is believed to be understandable by both the color scientist and the novice. Thus all instrument color readings were taken on a HunterLab LabScan Spectrocolorimeter, in Illuminant D65, with 10° observer, in 1976 CIE L*a*b* color space. All granular samples were read after oil had been removed from the granules. The oil removal procedure was as described in the Examples herein.

After the granules were deoiled, the granule preparation procedure of U.S. Pat. No. 4,582,425 was used. Briefly, this procedure consisted of loading a layout sample dish by slightly overfilling the dish with granules, compressing the granules into the dish with the flat surface of a layout tray, using only vertical pressure and no circular action. The loaded sample dish in each test was positioned on the layout device, matching the configuration, so that the sample dishes were in a locked position. A roll carriage was then gently lowered onto the sample dish, after which the roller is pulled back and forth across the surface on the face of the granules. It was found that twice across the surface produced the desired smooth, even, flat, and undented surface necessary for precise color readings. Excess granules fell over the sample dish edge.

The prepared granule sample dish was then placed into the instrument sample port. The sample surface was first examined to insure that the sample has not "popped" and lost its smooth level surface.

Two complete spectrocolorimeter readings (scans) were taken, completely emptying and repeating the layout procedure each time. The procedure was repeated until two readings consistent with each other to within less than 0.3 unit range were obtained. If not, the procedures were repeated with more attention to detail. All samples presented to the spectrocolorimeter for color difference determination were at ambient temperature (hot granules give inaccurate color readings, as do wet granules). After deoiling the granules in accordance with the procedure explained below, the granules were in all cases rad within four hours of deoiling. (Samples left in an uncontrolled condition may exhibit unwanted changes, and samples that have been deoiled and then left standing for a long period of time are not acceptable for spectrocolorimeter readings.)

In interpreting the results from the spectrocolorimeter, the opponent-color scales give measurements of color in units of approximate visual uniformity throughout the color solid. L* measures lightness and varies from 100 for perfect white, to zero for black, approximately as the eye would evaluate it. Further, a* and b*, the chromaticity dimensions, give understandable designations of color as follows: a* measures redness when plus, grey when zero, and greenest when minus; and b* measures yellowness when plus, grey when zero, and blueness when minus. Acceptable opponent color scales for the granules of the present invention are when all three of L*, a* and b* are within ±1.0 of the standard color granules.

The symbol, "delta" or "Δ" as used herein in connection with any of the above opponent color scale parameters refers to the difference between color space test values measured for two different samples, e.g., oiled/-deoiled versions of the same sample, tested on the same spectrocolorimeter machine under standard conditions. Also, the L*a*b* total color difference (ΔE) for any illuminant or observer is calculated as follows: $\Delta E=[(\Delta L^*)^2+(\Delta a^*)^2+(\Delta b^*)^2]^{\frac{1}{2}}$.

The invention and its advantages can be even better understood by reference to the following nonlimiting examples.

EXAMPLES

Example 1

In order to investigate and compare the performance in deoiled color, odor, oil removal properties and handability on pigmented inorganic particles, solvent removal comparisons were made on a common batch of pigmented inorganic particle granules with a number of different commercially available solvents described below including a solvent used in the present invention.

Samples of the granules were each deoiled in a manner as described generally hereinabove under the section entitled Deoiling Protocol. In particular, freshly manufactured white 9300-type roofing granules (less than one month old) were selected as the pigmented inorganic particles for deoiling. These particles all had naphthenic slate oil on the surfaces in an amount of about 8 lb/ton granules (about 4 kg/metric ton). The inorganic particles are mesh-screened to obtain the fraction having a size greater than 850 μm to less than 1.18 mm (−16/+20 U.S. standard sieve mesh) before deoiling. This fraction was subdivided into 15 parts to provide a sample for deoiling by each of 15 different solvents that were investigated, as described herein.

Then, 55 g of each sample of screened inorganic particles was introduced into a funnel-shaped receptacle as loosely supported by the support screen without compacting. The receptacle was a conical funnel structure having a first opening at the top thereof for introducing the inorganic particles having a diameter of about 7 cm, and a second opening at the bottom thereof for draining the solvent having a diameter of about 0.4. cm, and a screen support member located in a horizontal orientation inside the funnel in-between the two openings at about 3.2 cm above the second opening and about 5.8 cm below the first opening, and the apertures in the screen support had a size greater than 425 μm to less than 710 μm (−24/+40 U.S. standard sieve mesh) with the proviso that these apertures were smaller in size than the inorganic particles. The total volume of the receptacle was 130 $cm^3$, and the volume of the holding chamber of the receptacle for the inorganic particles was 120 $cm^3$, and the volume of the drainage chamber of the receptacle was 10 $cm^3$.

Each solvent investigated was then introduced into the upper opening of the funnel supporting a 55 g sampling of the screened inorganic particles in an amount of 100 ml solvent without stirring and with care taken to spread the deoiling solvent uniformly over the oily inorganic particles by hand pouring in a gentle swirling motion such that the deoiling solvent wetted all or substantially all the outer surfaces of the oily inorganic particles. During this application of the solvent to the inorganic particles, the receptacle was located inside an air hood.

Then, the deoiled particles were rinsed by filling the funnel to the rim with distilled water and without stirring. The solvent and water that drained from the funnel was captured for appropriate disposal or recycle.

After the water rinse, the particles were placed on a paper towel and dried in an oven. Drying was effected at 225° C. for 10 minutes. The dried particles were then cooled on paper towels to room temperature on a table top prior to making color determinations. The spectrocolorimeter analysis was then performed on the deoiled dried inorganic particles as follows.

During the deoiling procedures, the odor of each solvent was analyzed by wafting fugitive vapors away from the mouth of a beaker containing the respective solvent, and handability of each solvent also was observed. The deoiled particles from each solvent also were analyzed for color by the color analysis described above under the section entitled TEST METHODS, Color Analysis Method: L*a*b* Scan Color Matching Test.

Also, a measure of the efficacy of the oil removal as accomplished by each solvent from a common batch of the roofing granules was assessed by determining ΔE values for samples of particles deoiled by each of the investigated solvents. In general, the larger the magnitude of ΔE, the greater the color change, which is an indication of greater oil removal.

The results for each test were assigned a score of from 1 to 5, with "1" being most superior and "5" being poorest. Then, a total score was determined for each solvent by adding the three individual scores for the categories of deoiled color match, odor, and removal of oil. While the grading system is subjective to some extent, definitive trends in the results were discernible to permit a valid judging of the relative deoiling performance of the respective solvents.

The results are summarized in Table 1. The solvents investigated were as follows, wherein the compositions were described, if known.

| Solvent | Tradename | Composition |
|---|---|---|
| 1 | BBA K411: | 90% d,l-limonene, 10% terpene alcohols |
| 2 | BIOACT AE-O: | 65–95% terpene HC, 5–35% nonionic surfactant |
| 3 | BBA K102: | 90% d,l-limonene, 10% terpene alcohols |
| 4 | ZEP DYNA 143: | terpene of unknown composition |
| 5 | ZEP C-SOLV TM: | 30–40% d-limonene, balance unknown |
| 6 | ZEP BIG ORANGE TM: | 90% d-limonene, 5% ethoxy alcohols |
| 7 | — | 1,1,2-trichloroethylene |
| 8 | Bulldozer Degreaser: | morpholine oxide + NaCl |
| 9 | QUAKER SOLVO CLEA: | mineral spirits |
| 10 | LPS PRESOLV: | naphtha based solution |
| 11 | DESOLV IT ®: | mineral oil + orange oil (U.S. Pat. No. 3,933,674) |
| 12 | T&R MSOL: | non-citrus para-menthadienes |
| 13 | CitriKleen ® XPC | d-limonene emulsion, balance unknown |
| 14 | PF TM Degreaser: | 10–30% d,l-limonene, 90–70% aliphatic petroleum distillates (100% aliphatic) |
| 15 | — | 1,1,1-trichloroethane |

TABLE 1

| Solvent | Deoiled Color Match | Odor | Removal of Oil | Total | Other Comment |
|---|---|---|---|---|---|
| 1 | 1 | 2 | 1 | 4 | |
| 2 | 1 | 3 | 1 | 5 | |
| 3 | 1 | 2 | 1 | 4 | |
| 4 | 1 | 1 | 1 | 3 | |
| 5 | 1 | 5 | 1 | 7 | ext'd drying req'd |
| 6 | 2 | 5 | 2 | 9 | |
| 7 | 1 | 1 | 1 | 3 | |
| 8 | 5 | 1 | 5 | 11 | |
| 9 | 1 | 5 | 1 | 7 | ext'd drying req'd |
| 10 | 3 | 1 | 3 | 7 | aerosal hard to handle |
| 11 | 4 | 1 | 4 | 9 | |
| 12 | 2 | 1 | 2 | 5 | |
| 13 | 3 | 1 | 3 | 7 | |
| 14 | 1 | 1 | 1 | 3 | |
| 15 | 1 | 1 | 1 | 3 | |

As shown in the above results summarized in Table 1, the results were highly unpredictable and varied even despite some seeming or partial similarities between some of the solvent compositions. In particular, of the nonchlorocarbon based solvents of known composition, only the method of the present invention using Solvent 14 containing the blend of monocyclic terpene and aliphatic petroleum distillates provided acceptable deoiling handability, pungency, removal of oil, and color analysis repeatability.

Example 2

In order to compare and demonstrate the correlation in deoiling action on pigmented inorganic particles between 1,1,1-trichloroethane in particular and the deoiling solvent used in the present invention, the following study was performed.

A five gallon bucket of standard brown roofing granules of the designation 4100-type were hand screened to obtain the fraction at −16/+20. The sample of 4100-type roofing granules selected was a freshly manufactured sample (less than one month old) which had about a 4 unit oil/deoil color difference. This screened fraction was subdivided and sent to six different 3M plant sites, indicated below, for deoiling of separate samples thereof with each of the deoiling solvent of the present invention and 1,1,1-trichloroethane followed by comparative L*a*b* scan color analyses.

Several testors at each of six differently located 3M plants; designated as Belle Mead, Corona, Havelock, Little Rock, Wausau and St. Paul, were each given replicate samples of the screened brown 4100. Four testors at the Corona facility, designated Testors 5, 6, 7, and 8, each deoiled several separate samples of the granules using 1,1,1-trichloroethane according to the standard deoiling procedure described in the above Description of the Related Art (15 minute deoil). On the other hand, four testors at each of Belle Mead, designated Testors 1, 2, 3, and 4; Havelock, designated Testors 9, 10, 11, and 12; Little Rock, designated Testors 13, 14, 15 and 16; Wadsad, designated Testors 17, 18, 19 and 20; and St. Paul, designated Testors 21, 22, 23, and 24; each deoiled several separate samples of the granules with PF TM Degreaser, commercially available from PF Technologies, Inc., Safety Harbor Fla., having a formulation described herein, as representing the deoiling solvent of the present invention, according to the procedure described in Example 1 above.

Then, the testors performed a L*a*b* scan color analysis, as described in the TEST METHODS hereinabove, on each oiled and deoiled sample to determine each of the parameters L*, a*, and b*, respectively, and their respective Δ values. These results are summarized in FIGS. 2–4. In each of FIGS. 2–4, the abscissa axis indicates which of the above-identified 24 testors did the measurements to determine the ΔL*, Δa*, or Δb* scan color value that is indicated vertically directly thereabove by an "*" symbol. That is, the ordinate axis quantifies the actual Δ observed when taking the inorganic particles from the initial oiled state to the final deoiled state, as calculated as the difference between the before and after deoiling L*, a*, or b* scan color values measured by the respective testor. The numbers "2" and "3" in the data field indicate that many respective data points are associated with the adjacent symbol "*".

Figure 2:
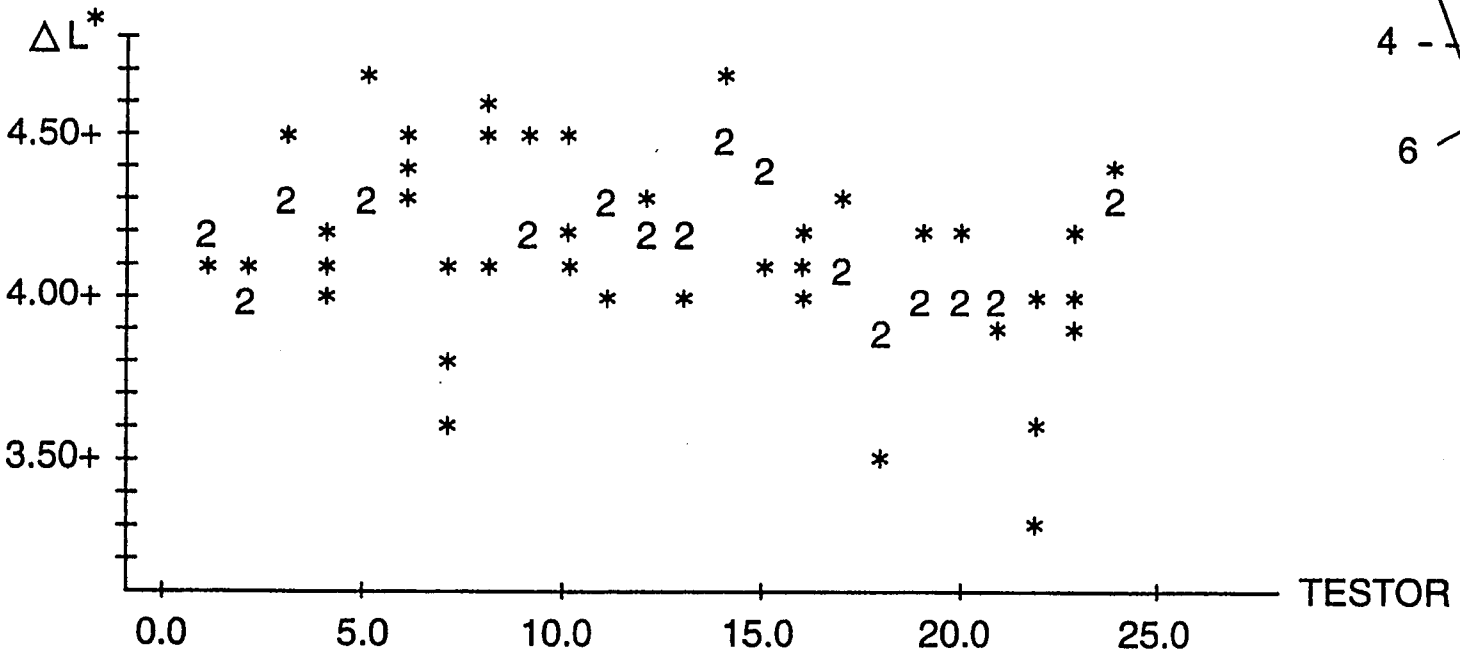
FIG. 2 depicts ΔL* color data obtained for oiled to deoiled 4100-type brown roofing granules, which were deoiled in separate tests by 1,1,1-trichloroethane and the deoiling solvent used in the present invention, as described in Example 2 herein.
Figure 3:
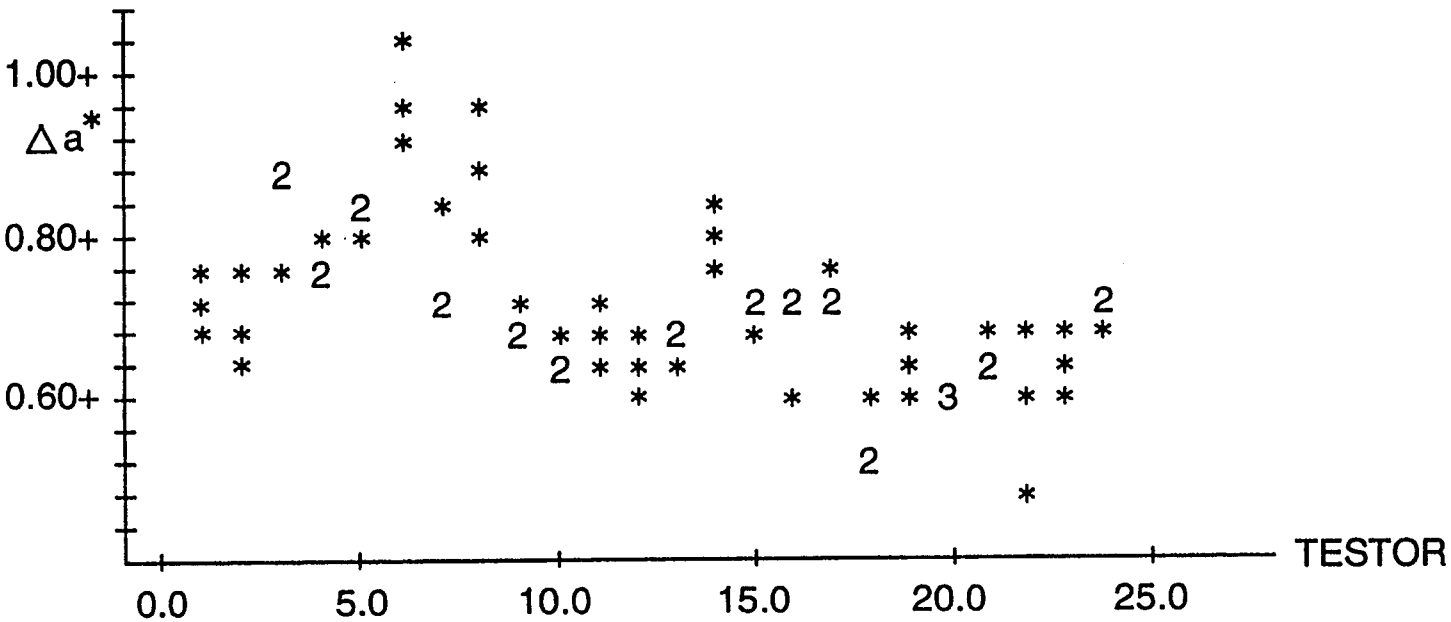
FIG. 3 depicts Δa* color data obtained for oiled to deoiled 4100 type brown roofing granules, which were deoiled in separate tests by 1,1,1-trichloroethane and the deoiling solvent used in the present invention, as described in Example 2 herein.
Figure 4:
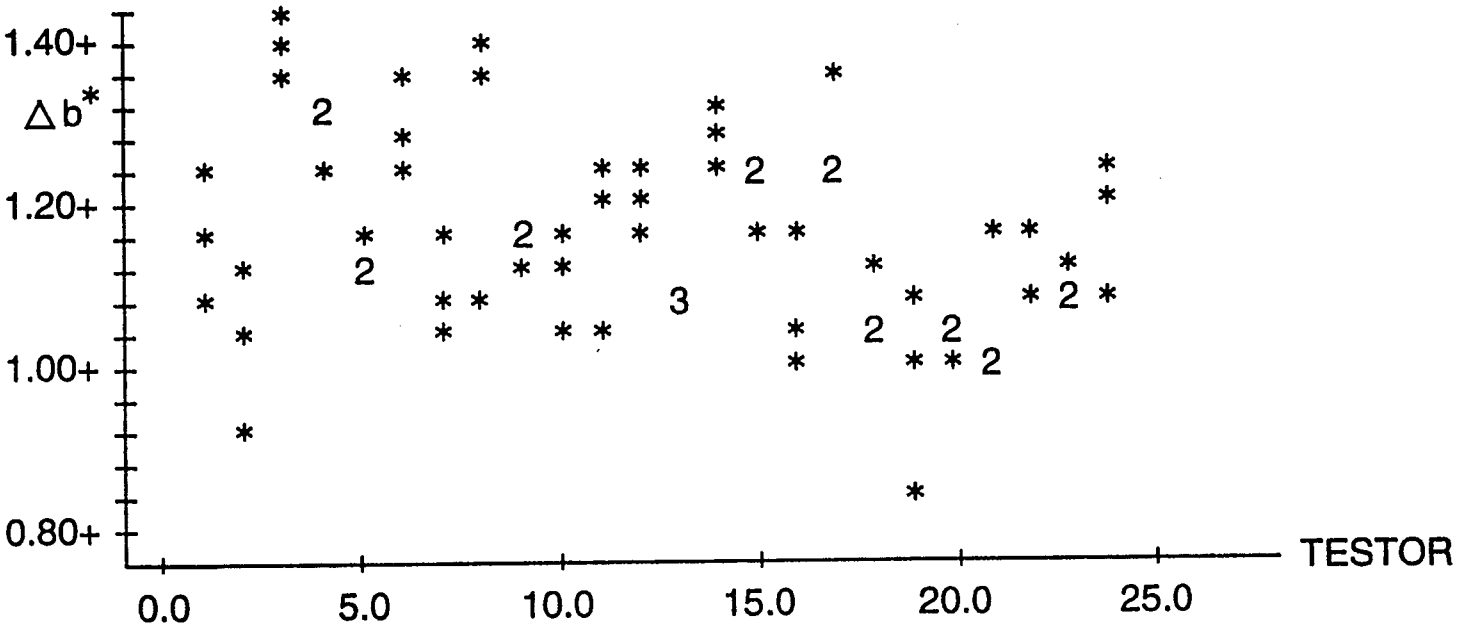
FIG. 4 depicts ΔAb* color data obtained for oiled to deoiled 4100-type brown roofing granules, which were deoiled in separate tests by 1,1,1-trichloroethane and the deoiling solvent used in the present invention, as described in Example 2 herein.

As seen by the results in FIGS. 2–4, the Δ values for the L*, a*, and b* readings are relatively closely comparable between the samples deoiled by 1,1,1-trichloroethane and those deoiled by the solvent representative of the present invention. These results show that the use of the solvent of the present invention to deoil pigmented inorganic particles, such as roofing granules, is fairly predictive of and comparable to the deoiled color associated with 1,1,1-trichloroethane. Therefore, the use of the solvent of the present invention to deoil inorganic particles having pigment in an outer layer thereof represents a highly suitable and attractive replacement to the use of 1,1,1-trichloroethane, which must be phased out of usage.

While the invention has been described in detail and with reference to specific embodiments thereof, it will be apparent to one skilled in the art that various changes and modifications can be made thereto without departing from the spirit and scope thereof.

What is claimed is:

1. A method for deoiling oil residues from surfaces of inorganic particles each having pigment in an outer layer thereon, comprising:

(a) providing a structure having a wall portion which defines a receptacle, said wall portion including an upper wall portion which includes a first opening for introducing inorganic particles into said receptacle, a lower wall portion having a second opening therethrough for discharging liquids from said receptacle, said structure including a porous support member having a pore size which permits the passage of liquid but not said inorganic particles located in said receptacle between said first opening and said second opening to define a particle holding chamber;

(b) introducing an amount of said inorganic particles, without compacting, into said particle holding chamber of said receptacle at said first opening, whereby said inorganic particles are supported on said porous support member;

(c) introducing a deoiling solution comprising a mixture of monocyclic terpene and aliphatic petroleum distillates into said first opening in an amount and manner effective to flow downward through interstices between said inorganic particles to contact and wet substantially all said surfaces of said inorganic particles, whereby said deoiling solution removes said oil residues from said surfaces of said inorganic particles and flows out of said second opening;

(d) then, introducing water into said first opening to rinse said deoiled inorganic particles; and (e) drying said rinsed inorganic particles at a temperature and for a duration effective to volatize substantially all residual deoiling solution and water from said surfaces of said inorganic particles.

2. The method according to claim 1, wherein said deoiling solution comprises d,l-limonene in an amount of from about 10% to 30%, by weight, and aliphatic petroleum distillates in an amount of from about 90% to 70%, by weight, based on total weight deoiling solution.

3. The method according to claim 1, wherein said deoiling solution is contacted to said surfaces of said inorganic particles in an amount of from 45 to 85 ml deoiling solution/50 g inorganic particles.

4. The method according to claim 1, wherein said amount of deoiling solution is from 50 to 60 ml deoiling solution/50 g inorganic particles.

5. The method according to claim 1 wherein said inorganic particles are mechanically agitated in a manner effective to facilitate draining of said water during said rinsing of said inorganic particles without freeing said pigments from said outer surfaces of said inorganic particles.

6. The method according to claim 1, wherein said oil residues are selected from the group consisting of naphthenic slate oil, asphalt, or a mixture thereof.

7. The method according to claim 1, wherein said oil residues are present on said surfaces of said inorganic particles prior to said contacting with said deoiling solution in an amount of about 1 to about 10 kg oil residues/metric ton inorganic particles.

8. The method according to claim 1 wherein said inorganic particles each comprise a substrate containing a porous mineral or rock and said outer layer comprises a ceramic coating containing a silicate and said pigments.

9. The method according to claim 1, wherein said drying is effected at about 115° C. and for a duration of 6 to 13 minutes.

10. The method according to claim 1 wherein said drying is effected at 115° C. and for a duration of 10 minutes.

11. The method according to claim 1 wherein said receptacle comprises a funnel structure, wherein said first opening has a diameter of about 7.0 cm and said second opening has a diameter of about 0.4 cm and said support member is located in a horizontal orientation about 3.2 cm above said second opening and about 5.8 cm below said first opening, and said apertures have a size between, noninclusively, 425 μm to 710 μm, with the proviso that said size is smaller than said inorganic particles.

12. The method according to claim 10, wherein said support means extends horizontally across an entire cross-sectional area of said receptacle.

13. A method for deoiling oil residues from surfaces of inorganic particles each having pigment in an outer layer thereon and determining the color grade thereof, comprising:

(a) providing a structure having a wall portion which defines a receptacle, said wall portion including an upper wall portion which includes a first opening for introducing inorganic particles into said receptacle, a lower wall portion having a second opening therethrough for discharging liquids from said receptacle, said structure including a porous support member having a pore size which permits the passage of liquid but not said inorganic particles located in said receptacle between said first opening and said second opening to define a particle holding chamber;

(b) introducing an amount of said inorganic particles, without compacting, into said particle holding chamber of said receptacle at said first opening, whereby said inorganic particles are supported on said porous support member;

(c) introducing a deoiling solution comprising a mixture of monocyclic terpene and aliphatic petroleum distillates into said first opening in an amount and manner effective to flow downward through interstices between said inorganic particles to contact and wet substantially all said surfaces of said inorganic particles, whereby said deoiling solution removes said oil residues from said surfaces of said inorganic particles and flows out of said second opening;

(d) then, introducing water into said first opening to rinse said deoiled inorganic particles; and (e) drying said rinsed inorganic particles at a temperature and for a duration effective to volatize substantially all residual deoiling solution and water from said surfaces of said inorganic particles;

(f) performing a L*a*b* color analysis on said deoiled particles; and (g) comparing results of said L*a*b* color analysis against industry specifications applicable to said pigmented inorganic particles.

* * * * *